United States Patent [19]

Frentzel-Beyme

[11] Patent Number: 4,998,405

[45] Date of Patent: Mar. 12, 1991

[54] TWO-FOR-ONE TWISTING MACHINE

[75] Inventor: Johannes Frentzel-Beyme, Monchen-Gladbach, Fed. Rep. of Germany

[73] Assignee: Palitex Project Company GmbH, Fed. Rep. of Germany

[21] Appl. No.: 467,049

[22] Filed: Jan. 18, 1990

[30] Foreign Application Priority Data

Feb. 18, 1989 [EP] European Pat. Off. ..... 89102813.6

[51] Int. Cl.[5] ..... D01H 1/10; D01H 7/86

[52] U.S. Cl. ..... 57/279; 57/58.52; 57/58.7

[58] Field of Search ..... 57/279, 280, 52.49, 57/58.83, 58.7, 58.86, 354, 261, 262, 58.49, 261.2

[56] References Cited

U.S. PATENT DOCUMENTS

| | | | |
|---|---|---|---|
| 4,127,983 | 12/1978 | Munker | 57/58.7 X |
| 4,354,343 | 10/1982 | D'Agnolo et al. | 57/279 |
| 4,391,089 | 7/1983 | Billner et al. | 57/261 |
| 4,671,054 | 6/1987 | Grundmann et al. | 57/354 |
| 4,854,116 | 8/1989 | Lorenz et al. | 57/279 X |

FOREIGN PATENT DOCUMENTS

| | | |
|---|---|---|
| 2408563 | 8/1975 | Fed. Rep. of Germany . |
| 2065140 | 2/1976 | Fed. Rep. of Germany . |
| 2426724 | 2/1976 | Fed. Rep. of Germany . |
| 2718351 | 12/1978 | Fed. Rep. of Germany . |
| 2648621 | 11/1981 | Fed. Rep. of Germany . |

*Primary Examiner*—Daniel P. Stodola
*Assistant Examiner*—William Stryjewski
*Attorney, Agent, or Firm*—Bell, Seltzer, Park & Gibson

[57] ABSTRACT

A two-for-one twisting machine, comprising twisting spindles each having a threading device arranged in the region of the spindle axis, through which a yarn is sucked in by the action of an injector and ejected by means of a compressed-air jet in upward direction through the space between the feed package pot and balloon limiter. A yarn catching ring placed on the upper annular gap of the space between the feed package pot and balloon limiter serves to catch and position the yarn, which ring has in its interior a closed annular channel with a cross section open toward the annular gap, and is connected, via a radially outward extending connecting end, with a source of underpressure. The underpressure permits the yarn to enter into the annular channel and advance to the connecting end, where it is finally positioned.

6 Claims, 5 Drawing Sheets

TWO-FOR-ONE TWISTING MACHINE

FIELD OF THE INVENTION

The invention relates to a two-for-one twisting machine, comprising twisting spindles, which are each provided with a pneumatic yarn threading device arranged in the region of the spindle axis, which threading device allows to suck in the yarn by the action of an injector and to eject same through the space between the feed package pot and the balloon limiter, and to which a pneumatic yarn catching device is associated, which can be installed between the feed package pot and the balloon limiter for the purpose of catching and advancing the ejected yarn.

BACKGROUND OF THE INVENTION

In a two-for-one twisting machine of the aforesaid type it is necessary to catch the yarn, which shoots upward between the feed package pot and the inner jacket of the balloon limiter as it is threaded, and to advance same to the other portions of the device, the yarn being generally guided through a yarn guide eyelet and over an overfeed roll to a traversing yarn guide, whence it advances to a takeup package, which is normally driven by a package drive roll.

With manually operated spindles, it is in general not difficult to catch the yarn at the upper end of the space between the feed package pot and balloon limiter with the hand, after having visually recognized its location on the circumference, and to continue the threading.

However, a partially or fully automated procedure in the operation of twisting spindles requires a positioned yarn. This positioning relates at least to a partial range of the entire circumference of the annular gap. Shortly above the balloon limiter, the threaded yarn is, for example, taken over by correpondingly formed suction nozzles. In order to make the mechanized threading procedure fully operable, it it necessary to separate the rotor of the twisting spindle from the drive, so that the channel outlet on the yarn storage disk corresponds with the suction nozzle arranged above the balloon limiter.

A two-for-one twisting machine of the initially described type is disclosed, for example, in German Patent DE-C-26 48 621. In this known machine, a yarn guide tube with a longitudinal slot is arranged above the annular gap between the upper edge of the protective pot and balloon limiter, into which tube the yarn is inserted by means of a suction current. Associated to this yarn guide tube are further means for advancing and transferring the yarn.

Other two-for-one twisting machines of this type are described, for example, in German Patent DE-C-20 65 140.

Further known are two-for-one twisting machines, in which the yarn exits from the spindle at a predetermined point of the spindle circumference above the balloon limiter without having to position the spindle rotor. Such a device is disclosed, for example, in German Patents DE-C-27 18 351 and DE-C-24 08 563. In these known devices, an annular molded body is arranged on the underside of the rotating plate of the twisting spindle, which defines, together with the rotating plate and the yarn storage disk, an annular chamber, which is provided with an outlet opening terminating in the gap between the feed package pot and balloon limiter. The surfaces of baffles arranged inside the molded body see to it that either the rotating plate is rotated thereby providing an additional positioning effect, or, however, that the yarn is guided directly to a predetermined position on the twisting spindle.

The hitherto known devices have turned out to be expensive and not adequately reliable in operation. It is necessary either to provide the required individual devices on each twisting spindle or to associate same with a handling device. However, also the latter has turned out to be constructionally expensive, inasmuch as it is necessary to combine in one device both the spindle positioning and the means for a positioned upward movement of the yarns to be threaded.

OBJECT AND SUMMARY OF THE INVENTION

It is the object of the present invention to provide a two-for-one twisting machine of the initially described type and as defined in the preamble of claim 1 with simple constructional means, so that the yarn inserted in the space between the feed package pot and the balloon limiter is caught above the upper annular gap of this interspace, and brought to a defined position, without it being necessary to position the rotating plate of the spindle beforehand.

This object is accomplished in the present invention by the provision of a pneumatic yarn catching device for grasping and advancing the ejected yarn in the space between the feed package pot and the balloon limiter of the spindle of the two-for-one twisting machine and including a ring member positioned in a region above the space between the feed package pot and the balloon limiter and having a closed annular channel in the interior thereof and a cross section open toward the space between the feed package pot and the balloon limiter, and a connecting pipe adapted to be connected to an air source of suction and extending radially from the ring member for creating a suction air flow in the air channel.

The basic concept of the present invention consists in that during the threading a yarn catching ring is respectively arranged on the upper annular gap of the space between the feed package pot and balloon limiter. This ring catches the yarn as it shoots upward and guides same in a defined direction out of the region of the balloon limiter and retains same therein. It is possible to then advance the threaded and retained yarn via further known means to the takeup portion of the two-for-one twisting machine. As will become more relevant hereinbelow with reference to embodiments, the yarn catching ring may be movable or rigidly connected with the two-for-one twisting spindle.

BRIEF DESCRIPTION OF THE DRAWINGS

The following will describe an embodiment of the two-for-one twisting machine of the present invention with reference to the attached drawings, in which.

DETAILED DESCRIPTION OF THE PREFERRED EMBODIMENT OF THE INVENTION

Figure 1:
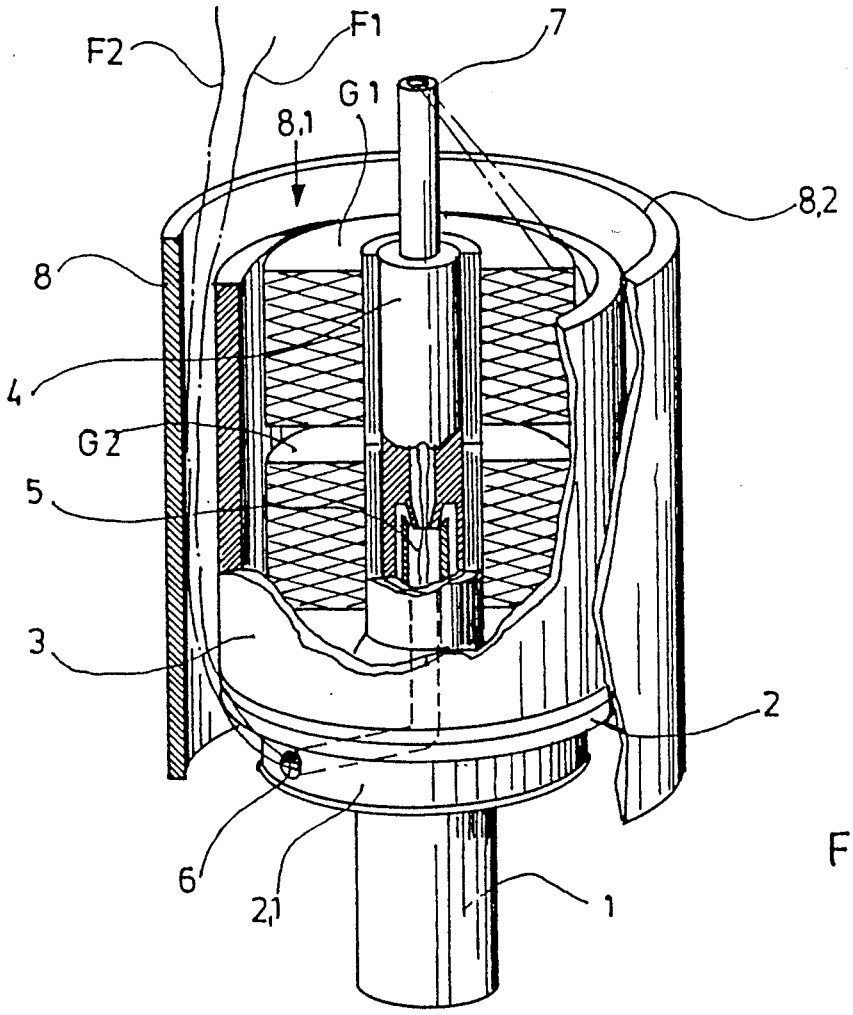
FIG. 1 is a perspective view, partially cut, of a two-for-one twisting spindle with yarns threaded therethrough.

Shown in FIG. 1 is a two-for-one twisting spindle, which is installed on a two-for-one twisting machine not illustrated in more detail. As is known, the two-for-one twisting spindle comprises a whorl 1, a driven rotor mechanism including a rotating plate 2 with a yarn storage disk 2.1 and a stationary carrier mechanism mounted on the rotor mechanism including a feed package pot 3 with a hollow pin 4 axially arranged therein, which accommodates yarn packages G1 and G2 and possesses a yarn inlet tube 7 at its upper end and defines a yarn passageway therethrough and through the rotor mechanism. Arranged in the yarn passageway and hollow pin 4 is an injector 5 known per se and not shown here in such a manner that its suction end connects to the yarn inlet tube 7, while its blowing end terminates in a yarn outlet channel 6 radially extending through the yarn storage disk 2.1 and forming a part of the yarn passageway. Further connected to the injector 5 is an air supply channel not shown here, which extends through the feed package pot 3 to connect on the outer circumference thereof to a source of compressed air.

The feed package pot 3 is in known manner surrounded by a balloon limiter s. The yarns F1 and F2 unwind from the two yarn packages G1 and G2, enter into the yarn inlet tube 7 by means of injector 5, and exit again through yarn outlet channel 6. The yarns then advance by means of the upward moving air current through the space between the feed package pot 3 and the balloon limiter 8, and finally reach an upper annular gap 8.1, where they are to be caught and positioned.

Figure 2:
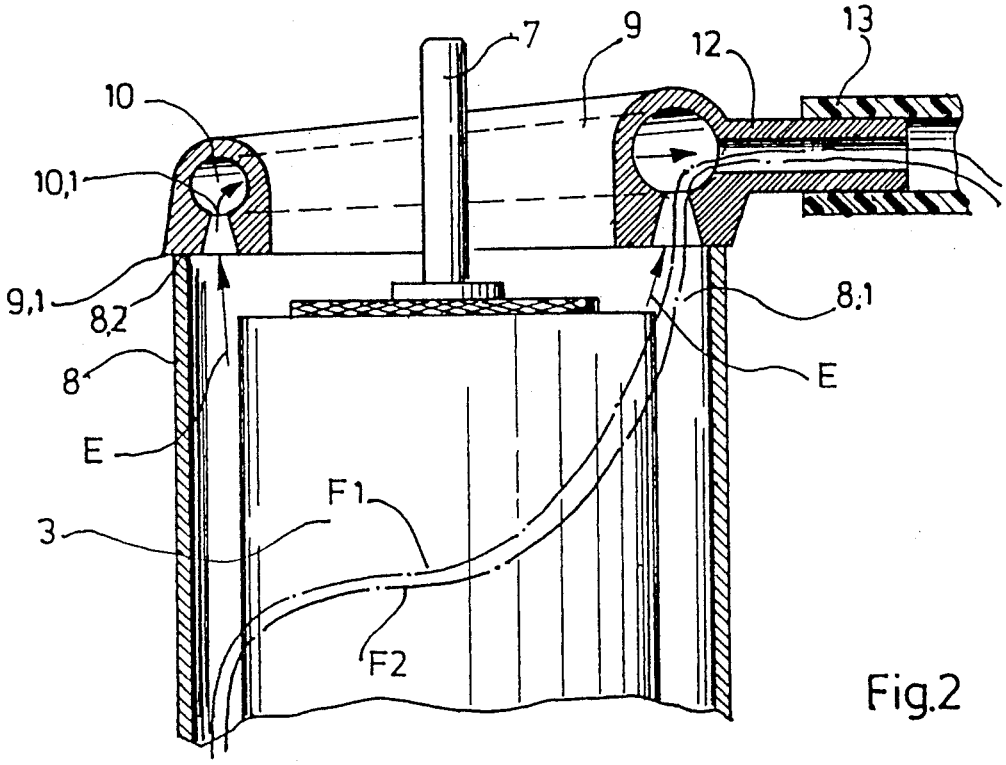
FIG. 2 is a side view, partially cut, of two-for-one twisting spindle of FIG. 1 with a yarn catching ring placed thereon.
Figure 3:
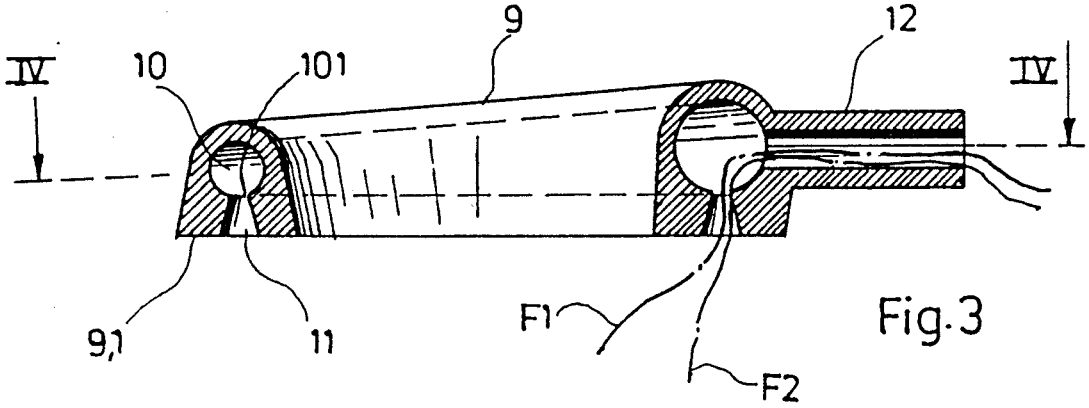
FIG. 3 is a vertical sectional view of the yarn caching ring of FIG. 2.
Figure 4:
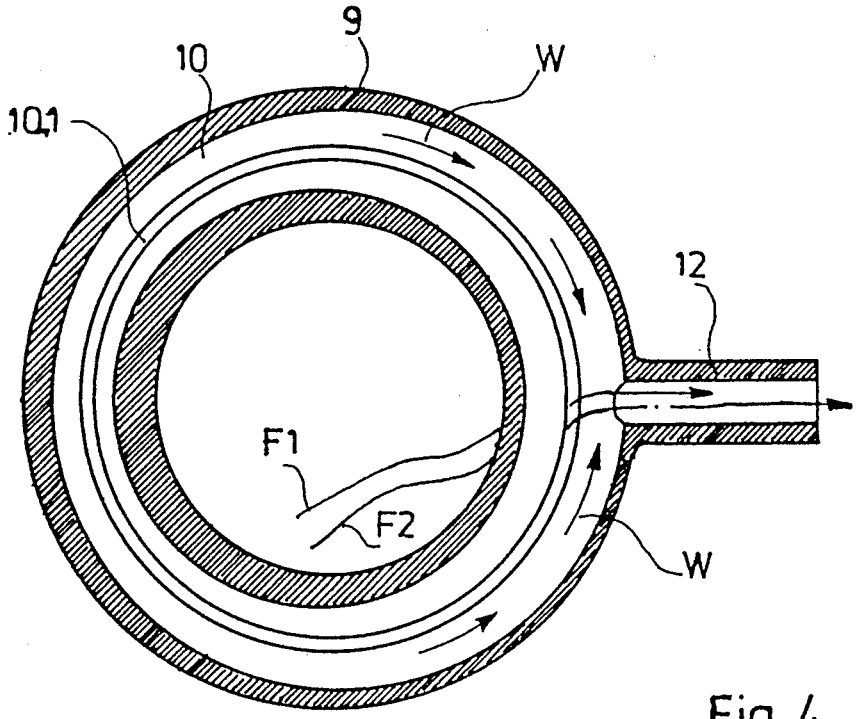
FIG. 4 is a sectional view along the line IV—IV of FIG. 3.

This is done by means of a device, which will be described with reference to FIGS. 2–4.

Arranged on the upper edge 8.2 of the balloon limiter 8 is a yarn catching ring 9 with its underside in the region of its outer circumference 9.1. This yarn catching ring 9 may form a part of a handling device not shown in more detail. With the assistance of this handling device, it is possible to thread the yarn to further devices of the two-for-one twisting machine.

In its interior, the yarn catching ring 9 is provided with a closed annular channel 10, which has a substantially circular cross section and possesses a passageway in the form of a slot 10.1, which terminates in a further, likewise annular and open inlet slot 11 flaring out downwardly to the annular gap 8.1. The annular channel 10 connects to a radially arranged connecting pipe or end 12, which can be connected via a line 13 with a source of underpressure not shown. To accomplish that substantially the same suction force is operative at all points of the circumference of annular gap 8.1, the annular channel 10 is designed, as can be seen in FIGS. 3 and 4, such that its cross section decreases starting from the connecting end 12 along the annular circumference in both directions to a point diametrically opposite to the connecting end 12.

The operation of the illustrated device is as follows: Once the yarn catching ring is placed on the balloon limiter 8, the yarns F1 and F2 unwinding from the yarn packages G1 and G2 are threaded by means of the injector 5 through the yarn inlet tube 7 into the hollow pin 4, which they leave at its bottom through an outlet opening provided in the circumference of the storage disk 2.1. A vacuum is applied, via the connecting line 13 and connecting end 12, to the annular channel 10, so that the yarns F1 and F2 in the space between the balloon limiter 8 and the feed package pot 3 are guided upwardly and sucked through the inlet slot 11 and the slot 10.1 into the annular channel 10 (direction of arrow E). In the annular channel 10, the yarns advance in direction of arrow W and finally enter into connecting end 12. Then, both the injector 5 and the source of underpressure connected to supply line 13 are disconnected. The yarns ends F1 and F2 are positioned in the connecting end 12, and can be grasped by hand or by a corresponding device, after the yarn catching ring 9 is removed, in the manner described hereinbelow with reference to FIGS. 5 and 6. As will also be described hereinbelow with reference to FIG. 7, the yarn catching ring can also be rigidly mounted on the balloon limiter. In this instance, the annular channel will have to be provided with a cross section opening toward the inside of the ring, and the yarn ends will be grasped and advanced by means of a suction nozzle.

Figure 5:
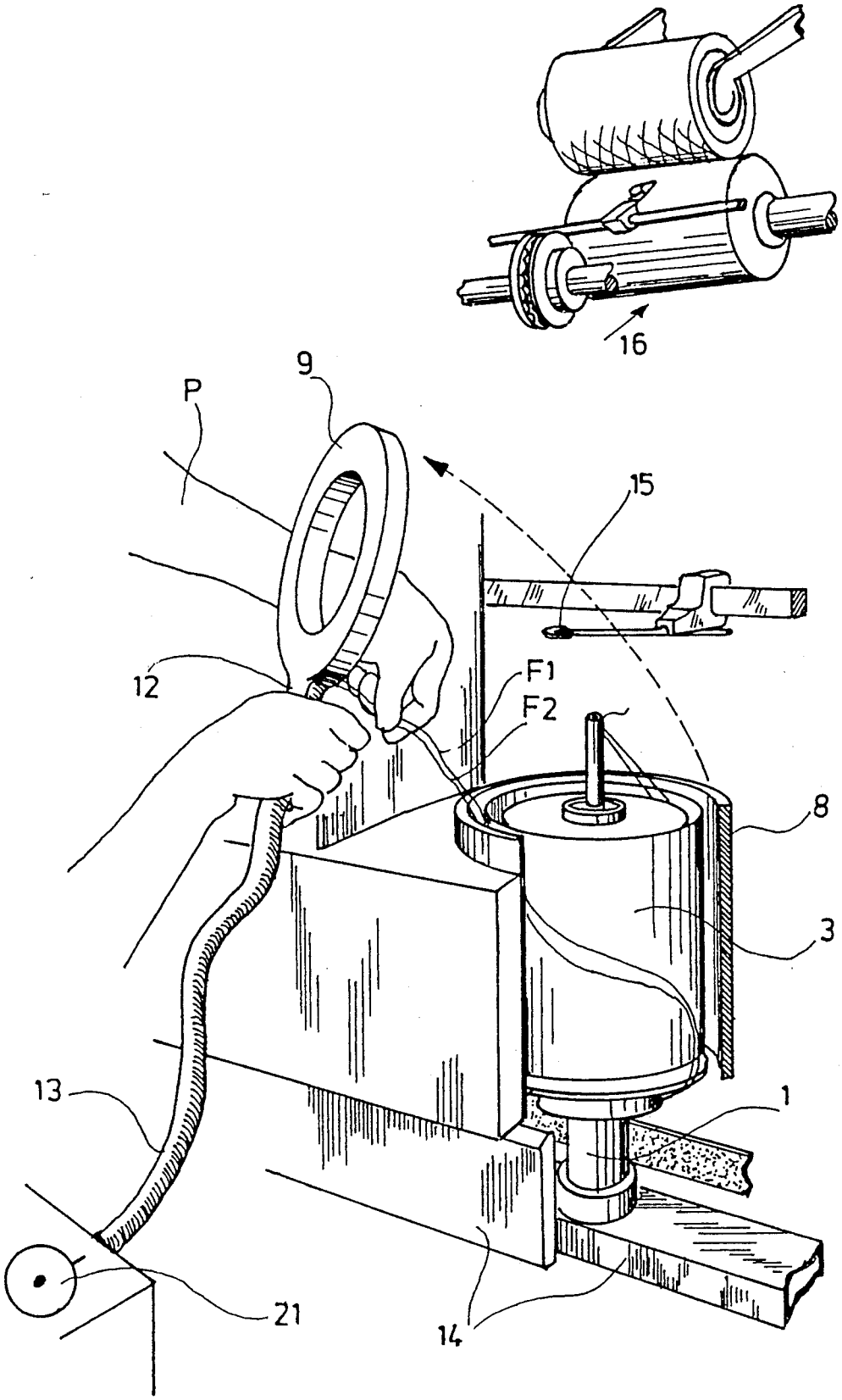
FIG. 5 is a perspective, partial view of a two-for-one twisting machine with a yarn catching ring arranged on a handling device.
Figure 6:
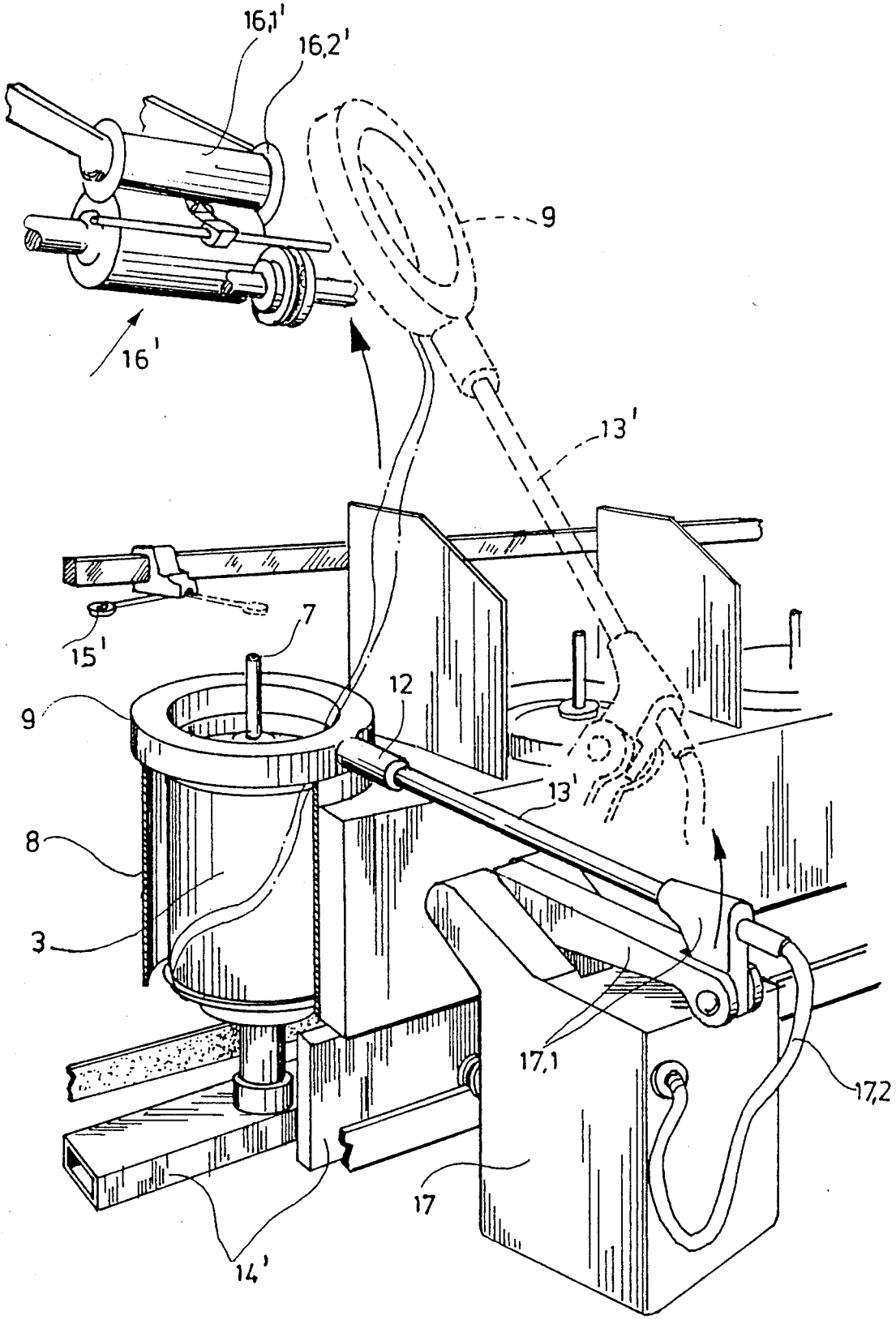
FIG. 6 is a perspective, partial view of a two-for-one twisting machine with a yarn catching ring arranged on an operating unit.
Figure 7:
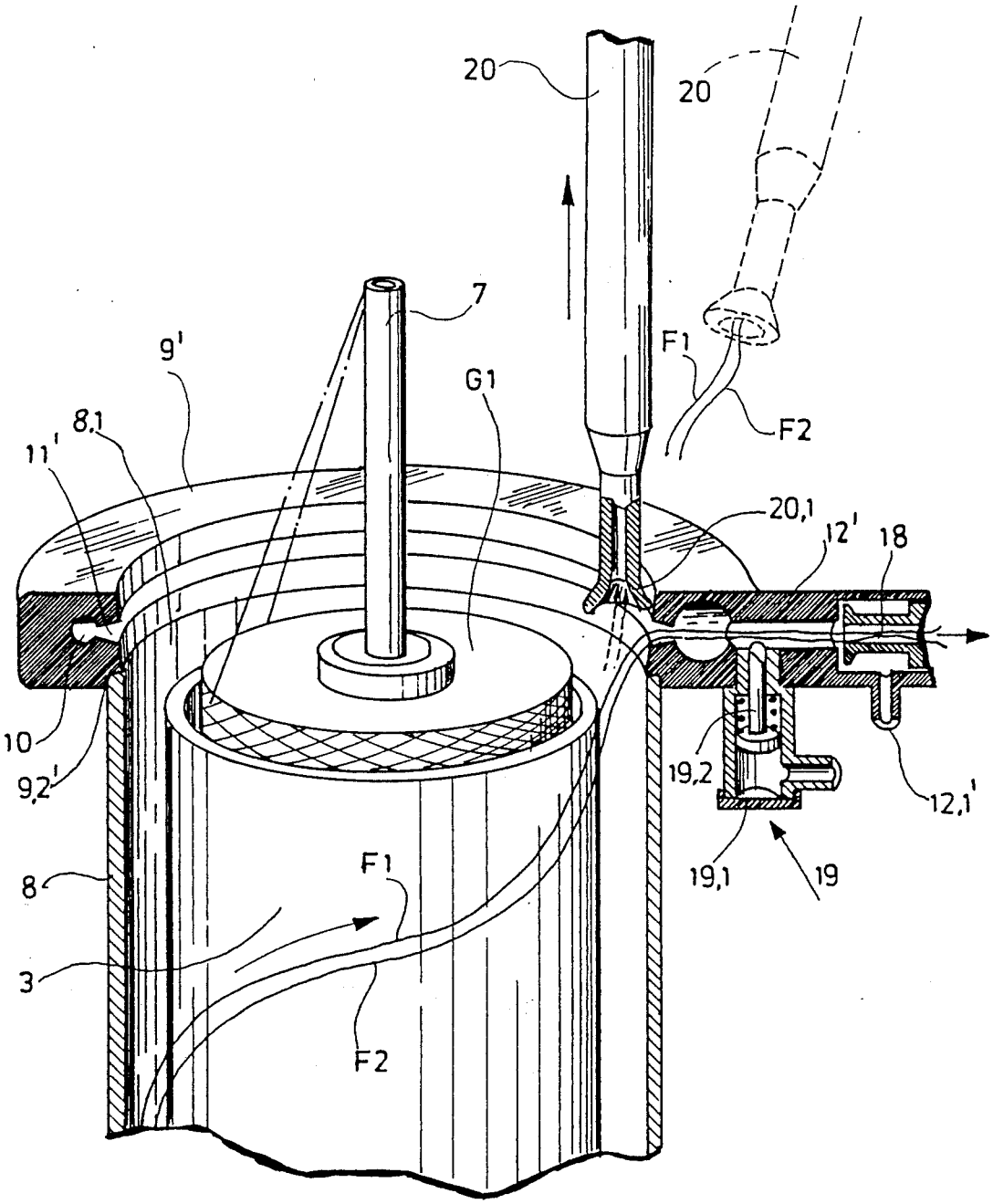
FIG. 7 is a perspective view, partially cut, of a two-for-one twisting spindle with a yarn catching ring rigidly attached thereto and a device for advancing the yarn.

The following will describe with reference to FIGS. 5–7 various embodiments of a yarn catching device associated with a two-for-one twisting machine.

The embodiment of FIG. 5 shows a twisting position of a two-for-one twisting machine 14. The yarn catching ring is designed and constructed as a handling device and is manually placed by an operator P on the balloon limiter 8 of the two-for-one twisting spindle. The connecting end 12 connects the yarn catching ring 9 with a pressure hose 13 leading a source of underpressure not shown. After the yarn ends F1 and F2 are positioned in the connecting end 12 of the yarn catching ring 9, same is again removed by hand, and the yarn ends F1 and F2 are pulled out of the connecting end 12. It is now possible to guide same by hand in a known manner through a yarn guide eyelet 15 of a schematically illustrated takeup system 16 of the two-for-one twisting machine 14.

FIG. 6 illustrates a portion of a two-for-one twisting machine 14′ with a yarn catching device, in which the yarn catching ring 9 with its connecting end 12 is connected via a line 13′ in the form of jointed rods with an operating unit 17 traveling along the two-for-one twisting machine. The line 13′ is connected, via a hose 17.2 with a source of underpressure accommodated in the operating unit 17. The joined rod 13′ is connected with a retractable articulated lever arm 17.1. Shown in solid lines in FIG. 6 is the yarn catching ring 9 in its position when placed on the upper edge of the balloon limiter 8. From this position, it can be moved by means of the articulated lever arm 17.1 to a raised position indicated by dashed lines. Once the yarn catching ring 9 is placed in position, the threaded yarn can, as already described, be caught and inserted into the connecting end 12. Proceeding from the operating unit 17, the yarn catching ring 9 including the supply lines is pivoted upward and moved additionally in direction of the cradle of the takeup system 16′. In so doing, the guiding plane of the yarn catching ring 9 with the sucked-in yarn ends is selected such that during the final pivoting movement the two yarn ends are clamped between the winding tube 16.1' and a centering plate 16.2' of the takeup system 16'. Once the self-threading balloon yarn guide 15' is returned to its initial position, the twisting position can restart.

Illustrated in FIG. 7 is an embodiment of a yarn catching device, in which the yarn catching ring 9' is stationarily arranged and rigidly connected with the balloon limiter 8. In this embodiment the yarn catching ring 9' has a somewhat different configuration in that the annular channel 10' does not open downwardly, but toward the inside of the yarn catching ring 9'. As can be noted from FIG. 7, the yarn catching ring 9' is installed with its underside in the region of its inner circumference 9.2'. Also in this embodiment, the yarn ends F1 and F2 are caught by the ring 9' in the aforesaid manner, and advanced through the annular channel 10' into the connecting end 12'. In this embodiment, an underpressure in the annular channel 10' is generated by an injector 18 arranged in the connecting end 12' with a lateral branch 12.1 of the injector 18 connecting to a source of underpressure not shown.

The advancement of the yarn ends F1 and F2 to the takeup zone of the two-for-one twisting machine, which is not shown, is accomplished by a suction nozzle 20, which is likewise connected to a source of underpressure not shown, and the funnel-shaped suction opening of which is arranged on the inside of the ring in the region of the connecting end 12'. As can be seen, the special design of the yarn catching ring 9' ensures that the suction nozzle 20 has access to the annular gap 8.1 even when the yarn catching ring 9' is in its installed position In this manner, it is possible to advance the yarn ends F1 and F2 without removing the yarn catching ring 9'. The suction nozzle 20 is part of an advancing means not shown in more detail. It can be raised from the position shown in solid lines in FIG. 7 to elevated positions, of which one is shown in dashed lines. For example, it will then be possible to clamp the yarn ends in the manner described with reference to FIG. 6 between the tube and centering plate of a takeup system not shown.

As a whole the aforesaid device for advancing the yarns ends in a known manner can, for example, be designed and constructed such as is described in German Patents DE-C 24 26 724 and DE-C 26 48 621. In order to guide a predetermined yarn length to the takeup zone, a cutting means 19 is arranged on connecting end 12, which cuts the yarn ends. It is provided with a cutting tool 19.2 actuatable via a compressed-air cylinder 19.1. A cutting operation is initiated when injector 18 signals back the acceptance of the two yarn ends.

Naturally, such a cutting device may also be provided in the embodiment described with reference to FIG. 6.

What is claimed is:

1. In a two-for-one yarn twisting machine having twisting spindles, each of said spindles including a driven rotor mechanism, a stationary carrier mechanism mounted on said rotor mechanism for carrying feed packages of yarn and having a pot surrounding the feed packages, a yarn passageway extending axially through said carrier mechanism and said rotor mechanism and radially out of said rotor mechanism for receiving yarn threaded therethrough from the feed package, a balloon limiter positioned around said feed package pot and defining a space therebetween for receiving a rotating balloon of yarn during twisting, and yarn threading devices including a air injector in said yarn passageway for sucking the yarn from the feed package into said yarn passageway and for ejecting the yarn through and out of said yarn passageway and up through said space between said feed package pot and said balloon limiter; the improvement of:

a pneumatic yarn catching device for grasping and advancing the ejected yarn and including a ring member positioned in a region above said space between said feed package pot and said balloon limiter and having a closed annular channel in the interior thereof and a cross section open toward said space between said feed package pot and said balloon limiter, and a connecting pipe adapted to be connected to an air source of suction and extending radially from said ring member for creating a suction air flow in said annular channel.

2. In a two-for-one yarn twisting machine, as set forth in claim 1, in which said annular channel of said ring member of said yarn catching device has a substantially circular cross section and in which said ring member further includes an outwardly flaring inlet slot extending annularly from said channel toward said space between said feed package pot and said balloon limiter for receiving the ejected yarn and allowing passage into said annular channel.

3. In a two-for-one yarn twisting machine, as set forth in claim 1 or 2, in which the cross section of said annular channel decreases in size from said connecting pipe along the circumference of said ring member in both directions to a point diametrically opposite to said connecting pipe so that substantially identical suction forces exist at all points of the circumference of said space between said feed package pot and said balloon limiter.

4. In a two-for-one twisting machine, as set forth in claim 1 or 2, in which said ring member of said yarn catching device is mounted stationary on said spindle, said annular channel includes a cross section opening toward the inside of the ring and in which said ring member is adapted to cooperate with a suction nozzle that can be arranged on the inner side of said ring in the region of said connecting pipe for the purpose of receiving the yarn therefrom and advancing it to other portions of said twisting machine.

5. In a two-for-one yarn twisting machine, as set forth in claim 1 or 2, in which said ring member of said yarn catching device is removably positioned in the region above the space between said feed package pot and said balloon limiter for manual movement therebetween to other portions in said twisting machine after grasping and advancing the ejected yarn.

6. In a two-for-one twisting machine, as set forth in claim 1 or 2, in which said yarn catching device further includes pivotally movable lever means carrying said ring member for movement between a position in the region above said space between said feed package pot and said balloon limiter for grasping and advancing the ejected yarn and other positions in said twisting machine.

* * * * *